US009783348B1

(12) United States Patent
Nguyen

(10) Patent No.: US 9,783,348 B1
(45) Date of Patent: Oct. 10, 2017

(54) PERSONAL DISPENSING SYSTEMS

(71) Applicant: Trong D Nguyen, Sacramento, CA (US)

(72) Inventor: Trong D Nguyen, Sacramento, CA (US)

( * ) Notice: Subject to any disclaimer, the term of this patent is extended or adjusted under 35 U.S.C. 154(b) by 0 days.

(21) Appl. No.: 15/468,378

(22) Filed: Mar. 24, 2017

(51) Int. Cl.

| | |
|---|---|
| ***B67D 7/06*** | (2010.01) |
| ***B65D 47/20*** | (2006.01) |
| ***B65D 47/32*** | (2006.01) |
| ***B65D 47/40*** | (2006.01) |
| ***B65D 81/20*** | (2006.01) |

(52) U.S. Cl.
CPC ..... *B65D 47/2012* (2013.01); *B65D 47/32* (2013.01); *B65D 47/40* (2013.01); *B65D 81/2076* (2013.01)

(58) Field of Classification Search
CPC .... B65D 47/2012; B65D 47/32; B65D 47/40; B65D 81/2076
See application file for complete search history.

(56) References Cited

U.S. PATENT DOCUMENTS

| | | | | |
|---|---|---|---|---|
| 4,473,174 | A | 9/1984 | Heuser | |
| 4,475,576 | A | 10/1984 | Simon | |
| 4,542,833 | A | 9/1985 | DeVaughn | |
| 4,595,121 | A * | 6/1986 | Schultz | B01F 5/0413 116/DIG. 8 |
| 4,674,662 | A | 6/1987 | Bergstrom et al. | |
| 4,706,847 | A | 11/1987 | Sankey et al. | |
| 4,856,680 | A | 8/1989 | Sitton | |
| 4,946,079 | A | 8/1990 | Campbell | |
| 4,982,879 | A | 1/1991 | Corrado et al. | |
| 4,984,711 | A | 1/1991 | Ellis | |
| 5,072,861 | A | 12/1991 | Jou | |
| 5,139,179 | A | 8/1992 | Cecil | |
| 5,180,081 | A | 1/1993 | McCann | |
| 6,230,944 | B1 | 5/2001 | Castellano | |
| 6,607,100 | B2 | 8/2003 | Phelps et al. | |
| 6,607,105 | B2 * | 8/2003 | Phelps | B67D 1/0406 137/329.4 |
| 6,742,678 | B1 | 6/2004 | Krystopik, Jr. | |

(Continued)

FOREIGN PATENT DOCUMENTS

| | | |
|---|---|---|
| EP | 2727878 A1 | 7/2014 |
| FR | 2616767 A1 | 12/1988 |

(Continued)

OTHER PUBLICATIONS

Wine Saver Pro, Manual, winesaverpro.com, Jul. 30, 2007.

(Continued)

*Primary Examiner* — Frederick C Nicolas
*Assistant Examiner* — Bob Zadeh
(74) *Attorney, Agent, or Firm* — Ernesto Garcia

(57) ABSTRACT

A personal aqueous dispensing system (PADS) and a personal oil dispensing system (PODS) feature common components each with a drip-catch. Both systems utilize nitrogen to extend the life of a consumable liquid or oil. The PODS incorporates a vent to facilitate flow of air into a bottle by preventing formation of airlock. Both systems feature dispensing control using a quarter turn rotation to control dispensing flow and both include a lid. The dispensing systems also features a switching device that triggers the filling of bottles with nitrogen.

24 Claims, 7 Drawing Sheets

(56) References Cited

U.S. PATENT DOCUMENTS 6,896,161 B2 * 5/2005 Patz ..... B65D 47/246 222/484
7,806,303 B1 * 10/2010 Hastings ..... B65D 47/243 222/481.5
8,011,540 B1 * 9/2011 Peckels ..... B01F 3/04099 222/190
8,123,086 B2 2/2012 Haley
8,141,746 B2 3/2012 Lambrecht
D657,675 S 4/2012 Averill
8,245,891 B2 * 8/2012 Eriksen ..... B65D 47/40 222/478
8,272,538 B2 * 9/2012 Weinberg ..... B67D 1/0418 222/152
8,490,832 B2 7/2013 Lambrecht
8,596,478 B2 * 12/2013 Gadzic ..... B65D 47/265 141/320
8,622,321 B2 1/2014 Vandaele
8,640,919 B2 * 2/2014 Lambrecht ..... B67D 1/0412 141/329
8,662,359 B1 * 3/2014 Hickey ..... B67D 7/005 220/745
8,783,512 B2 * 7/2014 Heatherly ..... B65D 47/32 222/478
2011/0240589 A1 10/2011 Averill
2015/0053725 A1 2/2015 Hingorani

FOREIGN PATENT DOCUMENTS

FR 2945526 A1 11/2010
WO 2006/081493 A2 8/2006
WO 2013/165405 A1 7/2013
WO 2014/155314 A1 2/2014

OTHER PUBLICATIONS

PrivatePreserve, privatepreserve.com, Feb. 2006.
NitroTap Wine Dispensing & Preservation, nitrotap.com, Jun. 15, 2013.
Coravinin™ 1000WINE Access System, www.coravin.com Aug. 2, 2013.
Wine Keeper, www.winekeeper.com, Fall/1983.
VineyardFresh Wine Preserver, vineyardfresh.com, Oct. 20, 2010.
Preservino Wine Preservation Systems, www.preservino.com, Jun. 30, 2013.

* cited by examiner

PERSONAL DISPENSING SYSTEMS

FIELD OF THE INVENTION

This disclosure is generally directed to personal dispensing systems utilizing a specially designed spout for reducing oxygen exposure to fluids such as olive oil or wine. The dispensing systems use injected nitrogen that can extend the life of the fluid.

BACKGROUND OF THE INVENTION

The air on earth has 21% A oxygen, 78% nitrogen and 1% of other miscellaneous gases. Oxygen in the air is very destructive to the quality of most food. Reducing exposure of oxygen from food is an effective method to preserve its quality before perishing. One of the popular practices of reducing oxygen exposure involves actively extracting air and mainly oxygen from inside an opened bottle. Simply capping or closing the bottle only keeps the air or oxygen already inside to degrade the food quality. Most commonly, bottles of partially consumed wine are capped with stoppers that create a vacuum. The air inside can be vacuumed out using either a manual or powered vacuum pump. The pumped out bottles remain sealed for a short period until their vacuum collapse due to external forces such as change in temperature. While pumping air out will temporarily extend the life of wine in a bottle, trying to vacuum a bottle requires excessive manual force by the user or powered vacuum pumps. Furthermore, each time the bottle is opened, the vacuum is lost and the liquid is mixed substantially with air during the pouring process thus its oxidation is accelerated with each pour event.

An approach of preserving the consumable liquid in a bottle is injection of inert gas such as argon or nitrogen. Nitrogen is preferred for it is more abundance and cheap being an industrial byproduct of oxygen production. Although there are considerable teachings of this method in prior art, none of them offers a practical and easy to use with multiple bottles at the same time. Systems offered by Wine-Keeper®, Wine Saver®, Wikeeps® and NitroTap® use high-pressure gas to push the wine out of the bottle dispensing it via a tap faucet. This method is expensive and cumbersome since it requires one tap for each bottle. Coravin®, on the other hand, uses thin hollow needle to pressurize and dispense the wine out of the bottle. So it only works with natural and not synthetic cork or screw cap. It pours very slowly at 25 seconds for 5 ounces and its needle is very susceptible to blockage by sediments in older wine. It also requires expensive argon cartridges at the cost approaching $1.00 to pour one average glass of wine. At the other end of the spectrum, Private Preserve®, Vineyard-Fresh® and Presevino® offers gas canisters for injecting a few quick bursts of argon inside the bottle after each pour. Their methods rely on the misconception that argon, being heavier than air, will blanket the wine surface to keep it fresh.

SUMMARY OF THE INVENTION

The present invention describes a convenient approach for dispensing and preserving liquids such as olive oil or wine by injecting nitrogen into a bottle and keeping the bottle sealed.

The present invention provides a personal aqueous dispensing system (PADS) comprising an insert suitable for wines. The insert is drip-proof and controllable to regulate pouring. The insert allows for the placement of a nozzle where nitrogen is introduced into a wine bottle via a flexible cap that can accommodate different bottleneck sizes. The PADS includes a unique lid that serves many functions and the insert is rotatable for opening or closing the insert for pouring or to adjust pouring to a drizzle. Nitrogen is introduced through a removable nozzle to fill the vacuum created by pouring the liquid from the bottle and the nitrogen is kept inside to prolong the life of the wine. Once the system is closed, the nozzle is removed. When using the wine bottle again, the nozzle is reinserted and nitrogen introduced into the bottle when the system is opened. In this way, one nitrogen nozzle can easily and economically serve to preserve many different bottles at the same time.

The present invention also provides for a personal oil dispensing system (PODS), which includes a drip-proof and controllable insert for regulating pouring of oil. Optionally, nitrogen can be injected into the bottle after pouring. A removable nozzle, where nitrogen is introduced into an oil bottle, can abut a soft silicone spacing seal where the nozzle will rest against the spacing seal to make a flow path into the bottle when the user presses and stretch the spacing seal with the nozzle creating a closed path with a vent in the insert. The insert features an elongated pour spout and a drip collection channel that guides the drip back into the bottle through the vent in the insert while the spacing seal is spaced from the vent of the insert.

The present invention uses a lid that serves to cover the insert of both systems. The lid serves to protect the insert from dust. The lid also serves to block a pilot vent of a nozzle so that the flow of nitrogen goes into the wine bottle while the lid is opened and rest against the nozzle. The lid utilizes at least one cantilever tab to assist opening the lid with one finger without holding the bottle. The same provides for an alignment tab that guides the lid into the insert when closing. The lid further provides for a notch so that one can flick open the lid with a thumb while holding the bottle.

The present invention envisions a flexible cap that includes an elongated vent, suction cavities, and annular grooves that also create suction. The flexible cap is designed to fits different sized bottles. The flexible cap further envisions indicators to indicate full flow or drizzle.

The present invention further incorporates a controllable insert where the user can regulate the amount of fluid flow. One can regulate pouring from drizzles for salads to fast pour for frying. The insert further incorporates catching running drip.

The present invention teaches a novel system where a gas nozzle connected to a pressure-regulated cylinder can be easily used to inject nitrogen at slightly above atmospheric pressure into a bottle only during pouring to totally backfill the outgoing fluid such that no air is allowed to enter the bottle. Similarly, the nozzle can then be used to pour liquid from another bottle. The injected nitrogen is not lost during subsequent pour even if injection of nitrogen is not done. In such incident, the inert gas already inside the bottle is only being diluted by the incoming air, which could be expelled by additional injection of nitrogen at a later time. Until then, the content inside the bottle is only exposed to relatively low oxygen as compared to the normal 21%.

Uniquely, the present invention can also be conveniently applied to bottles to preserve olive oil which is very susceptible to being degraded by oxygen in the air. Additionally, the same system offered by this invention can be used between bottles of wine and olive oil without allowing the gas nozzle to contact the oil. So it is always ready to use interchangeably with bottles of wine or other fluid. Another unique feature of this invention is that the injected nitrogen is always maintained at atmospheric pressure inside the bottle. So the "invasion" of oxygen in the air occurs only by molecular diffusion or permeability, which is a much slower process as compared to leaks or permeability of oxygen caused by pressure differential as a result of vacuuming.

Two embodiments of the cap are disclosed for each of the two systems. One of the caps allows for bidirectional rotation while the second design offers a quarter-turn rotation to allow the dispenser to open and close. In the quarter-turn deign of the cap, the cap offers a switching trigger component to activate a switch thus controlling a valve to inject nitrogen into a bottle. The invention envisions many forms of switching triggering mechanism such as mechanical, optical, magnetic, or combinations thereof.

DETAIL DESCRIPTION OF THE DRAWINGS

Figure 1:
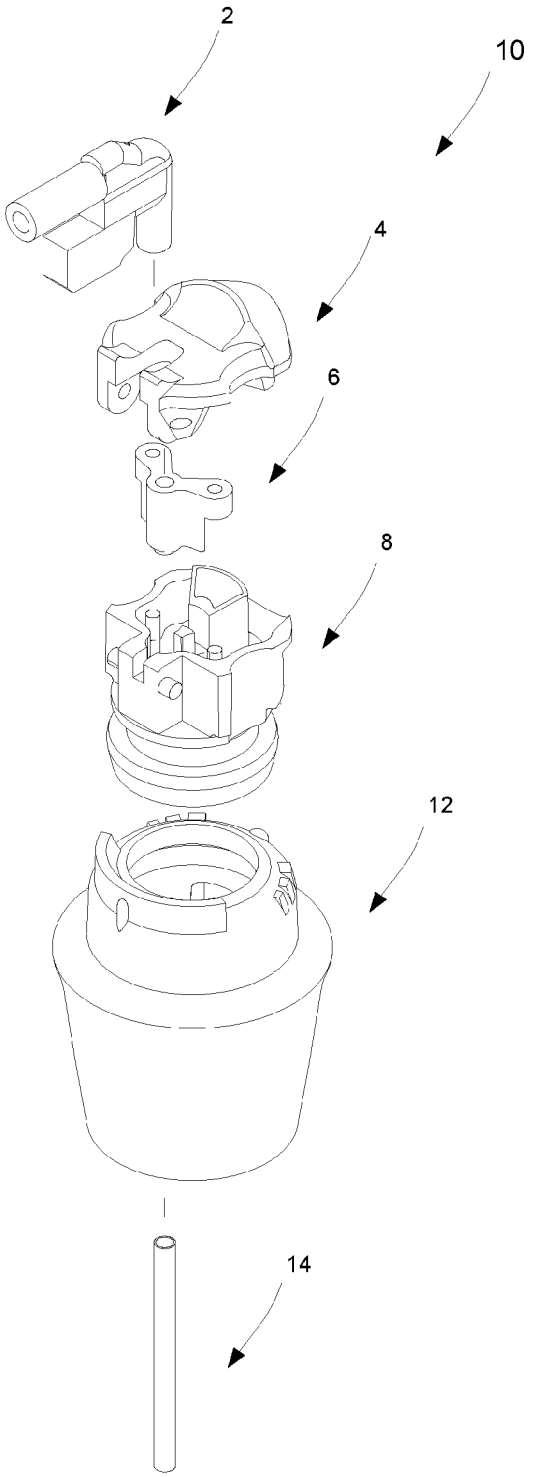
FIG. 1 shows an exploded view of a personal oil dispensing system.

FIG. 1 shows a personal oil dispensing system (PODS) 10 that includes a cap 12, an insert 8, a spacing seal 6, a lid 4, a removable nozzle 2, and a vent tube 14. The insert 8 is removable from the cap 12. As seen in FIGS. 12-15, the cap 12 is flexible and includes a hollow insertion portion 12*a* to accommodate a neck bottle. The cap 12 further includes a retaining portion 12*b* accommodating the insert 8. The insert 8 features an annular radial flange 8*b* at one end that is retained in an opening 12*e* below an inwardly directed flange 12*c* of the cap 12. The insert 8 features a grip body 8*a* at an opposite end of the insert 8. The cap 12 further features an arcuate stop 12*d* projecting from the retaining portion 12*b*. The arcuate stop 12*d* prevents the insert 8 from rotating when an alignment tab 8*m* hits either end 12*q* of the arcuate stop 12*d*. The cap 12 further features several indicators 12*x*-12*z*, 12*m*. Indicators 12*x*-12*z* have different sized shapes to indicate changing flow. Indicator 12*m* is set in an equator location to indicate full flow. A second set of indicators 12*x*-12*z* is mirrored from the equator to be symmetrical as the insert 8 is bidirectional when rotated. The cap 12 further features a pour opening 12*g* and a vent 12*f* that is 180 degrees apart from a center axis. Similarly, the insert 8 includes a pour opening 8*d* and a vent 8*f* so that when the insert 8 is rotated to the 12*m* indicator the pour opening 8*d* of the insert 8 is in alignment with the pour opening 12*g* of the cap 12. Moving the insert 12 to any of the indicators 12*x*-12*z* provides for controllable drizzle of the pour. The insert 8 includes a pair of opposite notches 8*n*, as shown in FIG. 14, to allow a user to grasp the insert 8 for turning.

Figure 2:
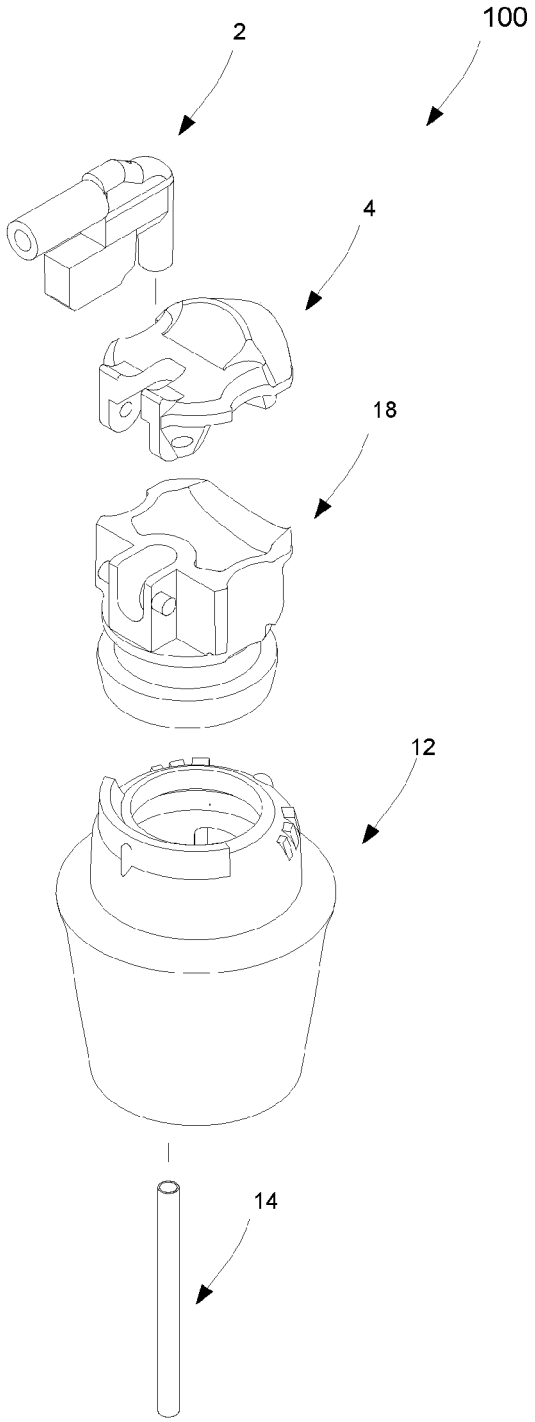
FIG. 2 shows an exploded view of a personal aqueous dispensing system.
Figure 3:
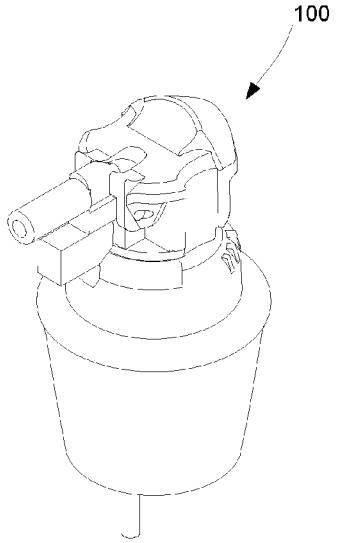
FIG. 3 shows an assembled isometric view of the personal aqueous dispensing system shown in FIG. 2.
Figure 15:
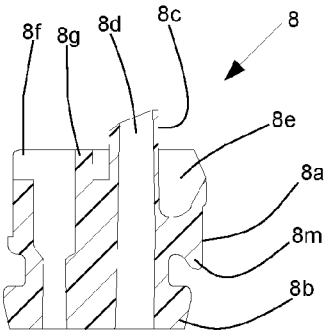
FIG. 15 shows cross-sectional view 15-15 of the oil insert shown in FIG. 14.
Figure 23:
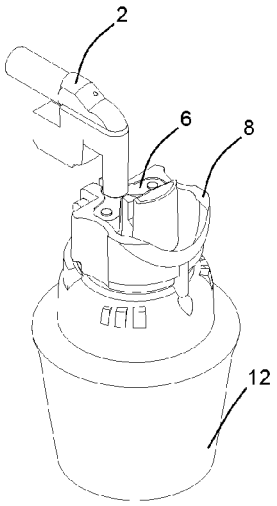
FIG. 23 shows an isometric partial view of the personal oil dispensing system without a lid as shown in FIG. 1.
Figure 24:
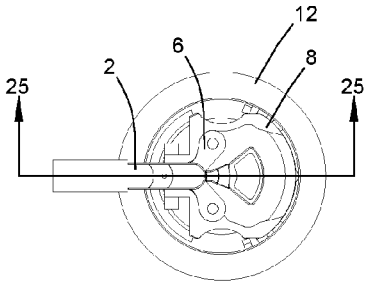
FIG. 24 shows a top view of the personal oil dispensing system shown in FIG. 23.
Figure 25:
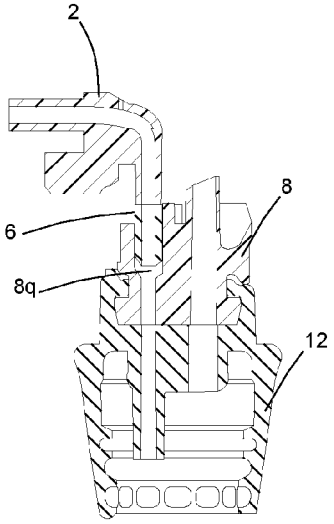
FIG. 25 shows cross-sectional view 25-25 shown in FIG. 24.

FIG. 2 shows a personal aqueous dispensing system (PADS) 100 that includes a cap 12, an insert 18, a lid 4, a removable nozzle 2, and a vent tube 14. Both systems 10, 100 use the same nozzle 2, the same cap 12, and the same vent tube 14 and both systems have different functions. In particular, the POD system utilizes a spacing seal 6 so that one can bridge a flow path to the vent 12*f* of the cap 12. The spacing seal 6 includes at least one retaining hole 6*e* that keeps the spacing seal 6 fixed to the insert 8. The retaining hole 6*e* seats on at least one fixing peg 8*h* thus spacing the spacing seal 6 from the vent 8*f*. When the nozzle 2 is placed against the spacing seal 6, the spacing seal 6 compresses a nipple 6*d* and seals the vent 8*f* thus forming a continuous flow path with a vent 6*f* of the spacing seal 6 for nitrogen to be inserted to a bottle 16. When the nozzle 2 is removed, the spacing seal 6 retracts to a normal size allowing a gap 8*q*, as seen in FIG. 25, to be formed so that a drip reservoir 8*e* of the insert 8 is in continuous flow with the vent 8*f*. As seen in FIG. 15, the drip reservoir 8*e* surrounds a pour spout 8*c* containing the pour opening 8*d*. FIGS. 23-25 show how one will position the nozzle 2 against the spacing seal 6 so that one can insert nitrogen gas into the bottle.

Figure 4:
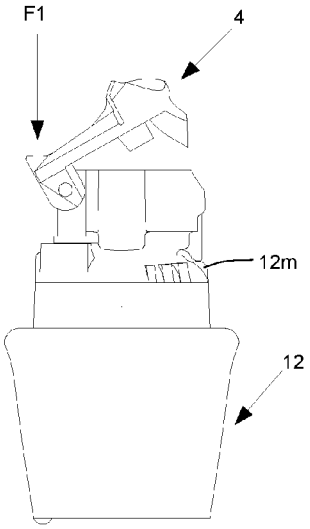
FIG. 4 shows a side view of the personal aqueous dispensing system with the lid opened.
Figure 16:
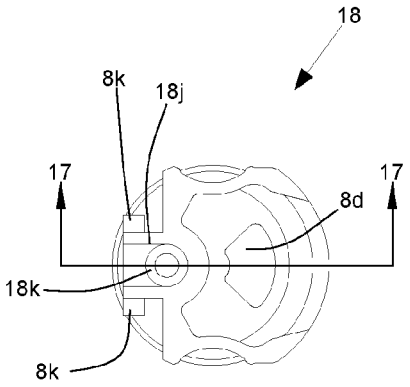
FIG. 16 shows a top view of an aqueous insert shown in FIG. 2.
Figure 19:
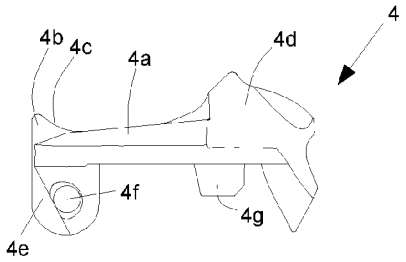
FIG. 19 shows a side view of the lid shown in FIG. 18.

FIGS. 14 and 16 show the insert 18 further including a pair of opposite directed pivot pins 8*k* mating with holes 4*f*, as seen in FIG. 4, that extend from pivot lugs 4*e* of the lid 4 as seen in FIG. 19. The pivot pins 8*k* provide for the lid 4 to hinge to an open position and a closed position. In the PAD system 100, the lid 4 opens to a position where it will abut the nozzle 2, as seen in FIG. 4. This is crucial as the lid 4 covers a pilot hole 2*e* of the nozzle 2 so that all nitrogen is directed toward the inside of a bottle 16. When the lid 4 is in a closed position, the flow of nitrogen can escape through the pilot hole 2*e*. This can occur especially when the insert 8 is moving towards a closed position, as the vent 18*f* of the insert 18 and the vent 12*f* of the cap 12 are no longer aligned.

Figure 6:
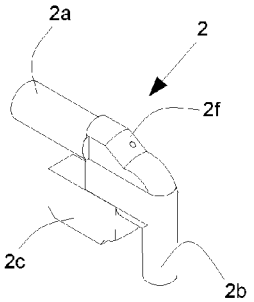
FIG. 6 shows an isometric view of an L-shaped connection nozzle shown in FIGS. 1 and 2.
Figure 7:
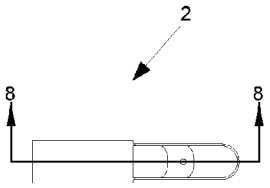
FIG. 7 shows a top view of the L-shaped connection elbow shown in FIG. 5.
Figure 8:
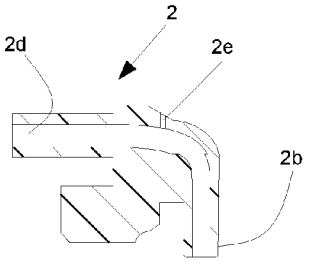
FIG. 8 shows cross-sectional view 8-8 of the elbow shown in FIG. 7.
Figure 9:
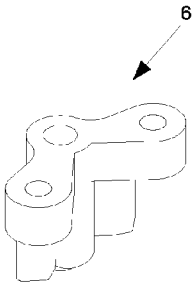
FIG. 9 shows an isometric view of a hanging seal shown in FIGS. 1 and 2.
Figure 10:
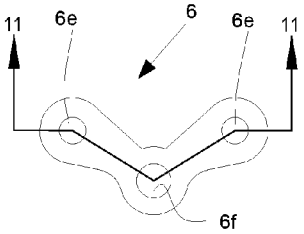
FIG. 10 shows a top view of the hanging seal shown in FIG. 7.
Figure 11:
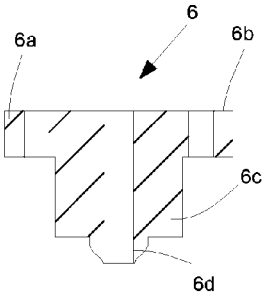
FIG. 11 shows cross-sectional view 11-11 of the hanging seal shown in FIG. 10.
Figure 12:
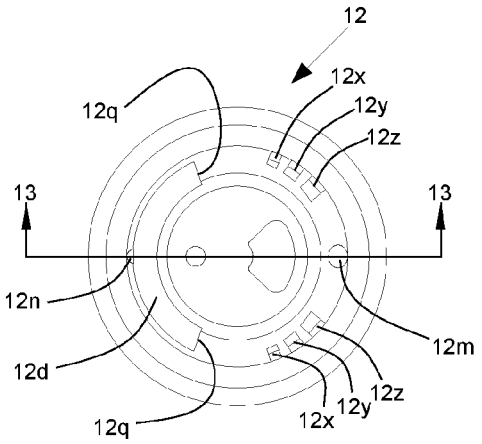
FIG. 12 shows a top view of a cap shown in FIGS. 1 and 2.

As seen in FIGS. 6-8, the nozzle 2 comprises a first conduit 2*a* and a second conduit 2*b* that is perpendicular to the first conduit 2*a* both conduits 2*a*, 2*b* forming a flow path 2*d*. The pilot hole 2*e* extends through the nozzle to the flow path 2*d*. The pilot hole 2*e* terminates at an external arcuate surface 2*f* so that when the lid 4 is in the opened position, as described above, a corresponding internal arcuate surface 4*h* covers the pilot hole 2*e* thus sealing the pilot hole 2*e*.

As seen in FIG. 6, the nozzle 2 further comprises a handle 2*c* that projects between the first conduit 2*a* and the second conduit 2*b*. The handle 2*c* provides a location for a user to grasp the nozzle 2 and place it inside the insert 2.

Figure 13:
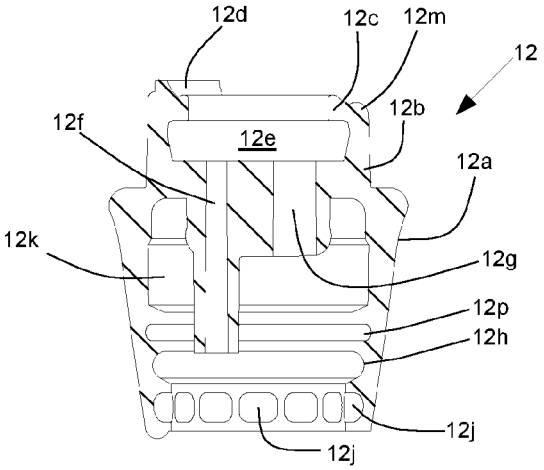
FIG. 13 shows cross-sectional view 13-13 of the cap shown in FIG. 12.
Figure 14:
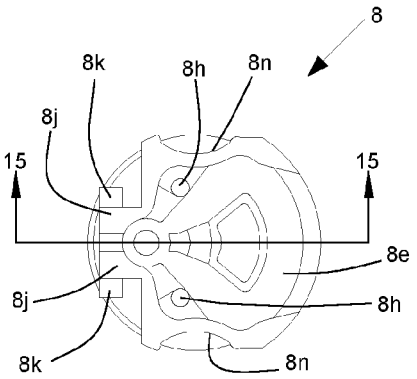
FIG. 14 shows a top view of an oil insert shown in FIG. 1.

As seen in FIG. 13, the cap 12 further includes a bottleneck opening 12*k*, two axially spaced annular grooves 12*h*, 12*p* adjacent to the bottleneck opening 12*k*, and circumferentially spaced suction cavities 12*j* below the annular groove 12*h*. The bottleneck opening 12*k* is designed to accommodate threaded and non-threaded bottlenecks as well as bottleneck with various sizes and external features such as threads. The circumferentially spaced suction cavities 12*j* assist is keeping the cap 12 in place to a bottleneck as they become suctioned to the bottleneck due to vacuum. An opposite indicator 12*n*, located opposite to indicator 12*m*, provides for an indication where one would insert the nozzle 2 when the insert 8 is in the opened position.

Figure 5:
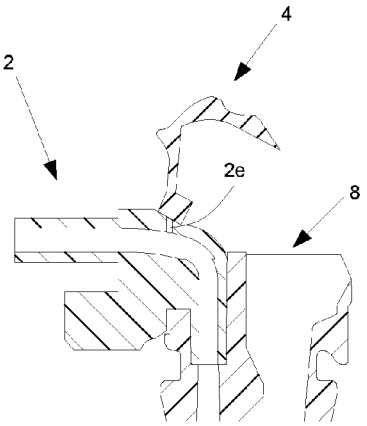
FIG. 5 shows a cross-sectional view showing the lid opened and abutting an L-shaped connection nozzle.
Figure 17:
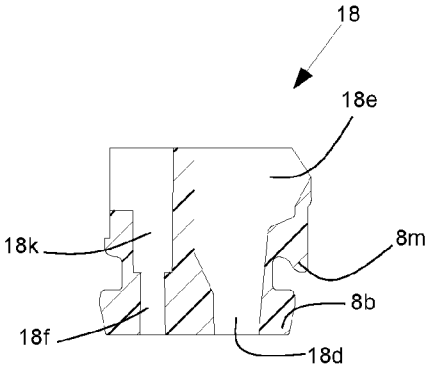
FIG. 17 shows cross-sectional view 17-17 of the aqueous insert shown in FIG. 16.

In the insert 18 of the PAD system 100, the vent 18*f* includes a counterbore 18*k*, FIGS. 16 and 17, that allows the nozzle 2 to sit snugly and in the same location so that the pilot vent 2*e* is blocked by the lid 4 when the lid is in the opened position for pouring as shown in FIG. 5. The insert 18 further includes a tapered nozzle 18*e* that is in continuous flow with a pour opening 18*d*.

Figure 18:
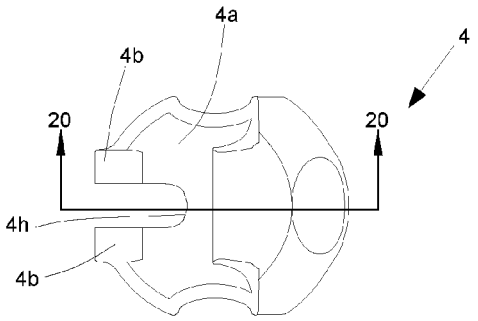
FIG. 18 shows a top view of a lid shown in FIGS. 1 and 2.
Figure 20:
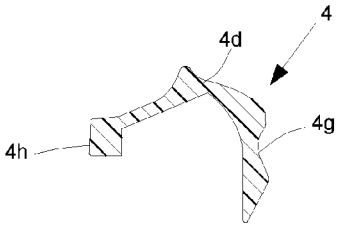
FIG. 20 shows cross-sectional view 20-20 of the lid shown in FIG. 18.
Figure 21:
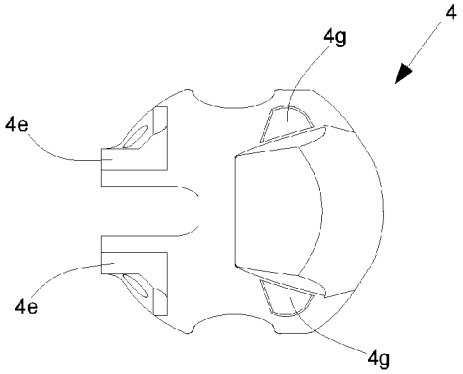
FIG. 21 shows a bottom view of the lid shown in FIG. 18.

As seen in FIGS. 18-20, the lid 4 further comprises a body 4*a*. The pivot lugs 4*e* extend from one side of the body 4*a*. To assist in opening the lid 4 with one finger without holding the bottle, at least one arcuate cantilever 4*b* is located in an opposite side to the body 4*a* and behind the pivot lugs 4*e*. The cantilever 4*b* includes a concave surface 4*c* to smoothly transfer a pushing force F1 as seen in FIG. 4 and yet continue rotating the lid 4 open. The lid 4 further features a closing tab 4*d* at one end of the body 4*a*. A pair of alignment tabs 4*g*, which are tapered, provide the lid to align itself as the lid 4 is in a closed position. An indentation 4*i* in the same location as the closing tab 4*d* assist in opening the lid 4 by flicking the lid 4 open with a thumb.

Figure 22:
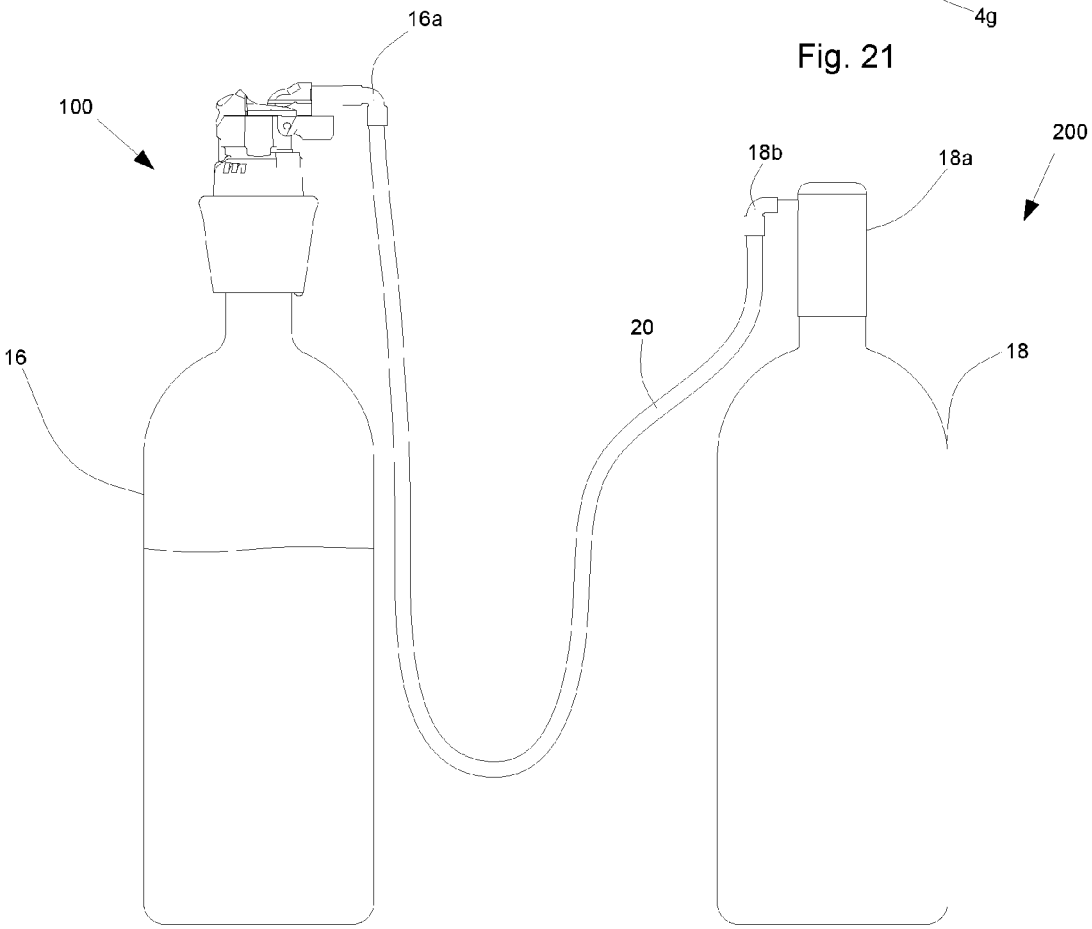
FIG. 22 shows a front view of a kit.

FIG. 22 shows the PAD system 100 in combination with a nitrogen system 200 comprising a nitrogen tank 18, a pressure regulator 18*a*, and a hose 20 is connected between two joint connectors 16*a*, 18*b*. The pressure regulator 18*a* is attached to the nitrogen tank 18 to provide nitrogen to either system 10, 100 at a low pressure, preferably near atmospheric pressure. The invention is envisioned to have either dispensing system 10, 100 sold without a nitrogen system 200, 300 or sold as a kit with a nitrogen system 200, 300 in the alternative. One skilled in the art will understand that the joint connector 16*a* connects with the nozzle 2 using any type of connector and that the joint connector 18*b* connects to the pressure regulator 18*a* in the same way or in a different way.

Figure 26:
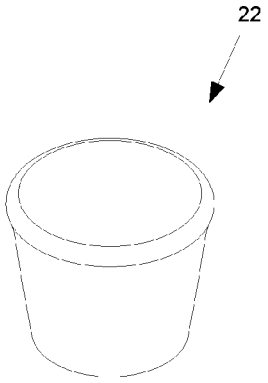
FIG. 26 shows an isometric view of an accessory cap.
Figure 27:
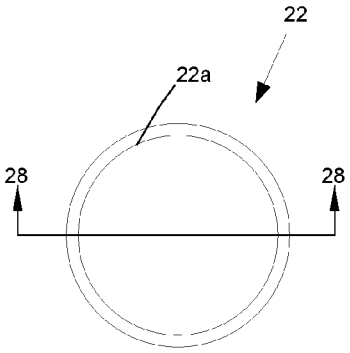
FIG. 27 shows a top view of the accessory cap shown in FIG. 26.
Figure 28:
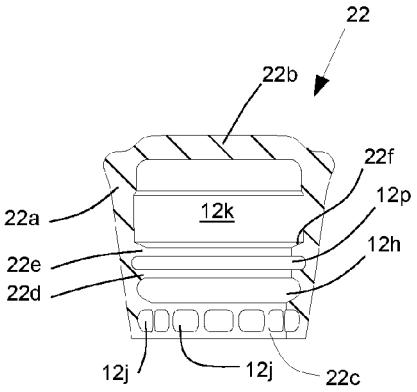
FIG. 28 shows cross-sectional view 28-28 shown in FIG. 27.

FIGS. 26 to 28 show a closed end cap 22 as an accessory to either personal dispensing system 10, 100. The end cap or accessory cap 22 is used to cap or close opened bottles for longer-term storage in between pour events. This cap provides better securement for storage since a bottle with this cap 22 does not take up space on top and has less chance of getting accidentally knocked off. The end cap 22 includes an annular main body 22*a* and a top wall 22*b* closing the annular main body 22*a*. The end cap 22 includes similar features as the cap 12 of the personal dispensing systems 10, 100. The main body 22*a* includes a bottleneck opening 12*k*, and a series of suction cavities 12*j* inwardly directed towards the center of the end cap 22. The main body 22*a* is tapered on the outside. The suction cavities 12*j* are circumferentially spaced inwardly at an opened end 22*c*. Adjacent to the series of suction cavities 12*j* is an annular suction cavity 12*h* to allow bottlenecks that have an annular rib at an end as commonly known. Next to the annular suction cavity 12*h* is another annular suction cavity 12*p* with a different shape and much bigger in diameter. The annular suction cavity 12*h* and the adjacent annular suction cavity 12*p* form a flexible wall 22*d* therein in between. Another flexible wall 22*e* is between the annular suction cavity 12*p* and the bottleneck opening 12*k*. The wall 22*e* contains a tapered wall 22*f*.

Figure 29:
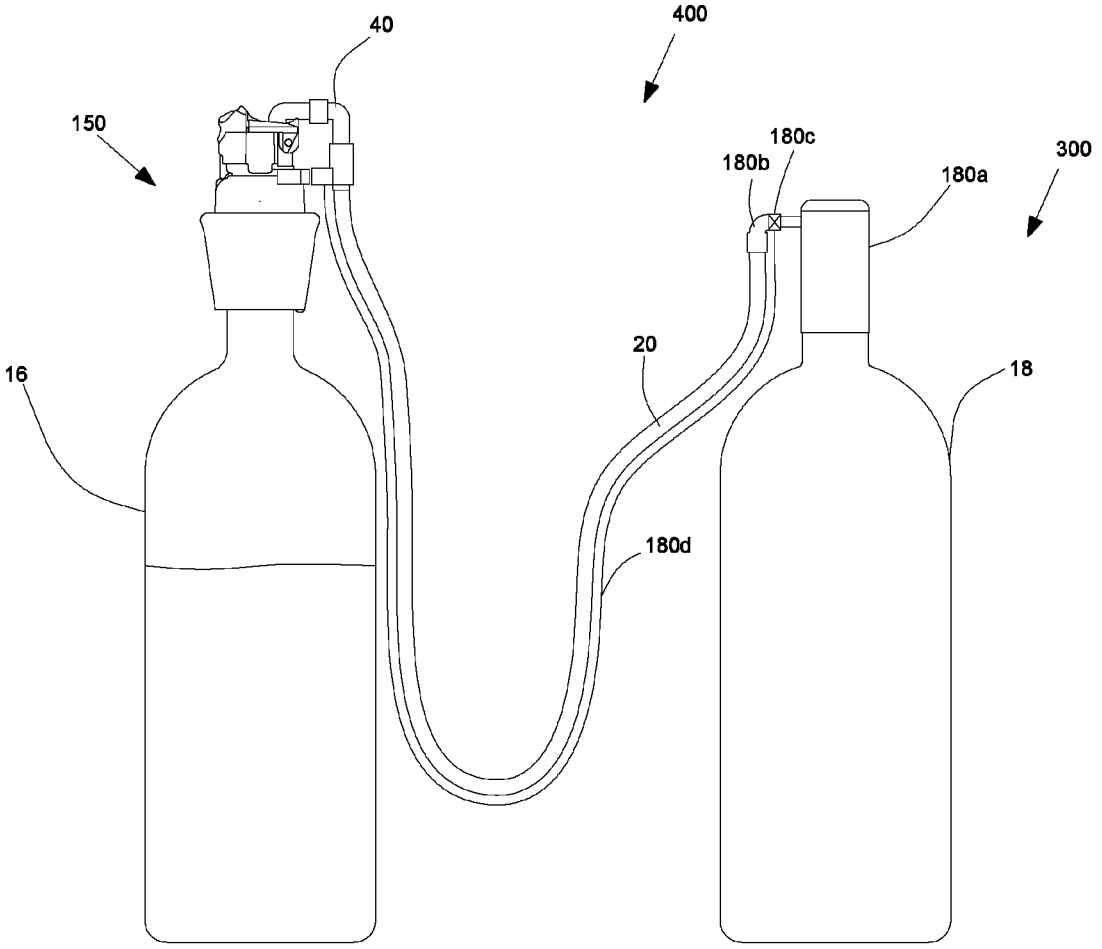
FIG. 29 shows a front view of a second embodiment of a kit.
Figure 30:
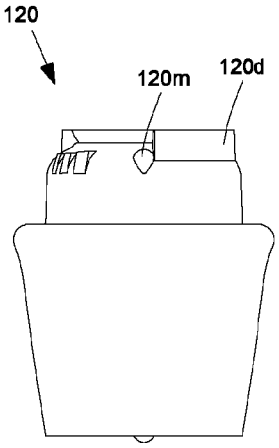
FIG. 30 shows a front view of a second embodiment of the cap.
Figure 31:
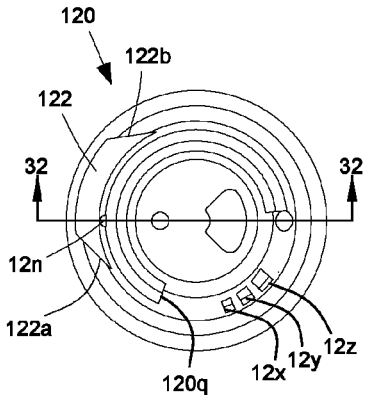
FIG. 31 shows a top view of the second embodiment of the cap shown in FIG. 30.
Figure 32:
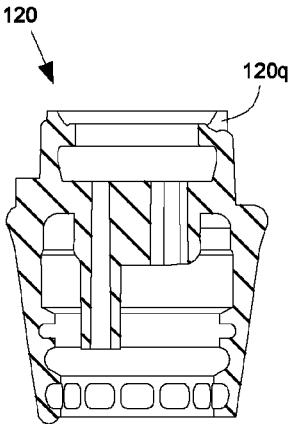
FIG. 32 shows cross-sectional view 32-32 of the cap shown in FIG. 31.
Figure 33:
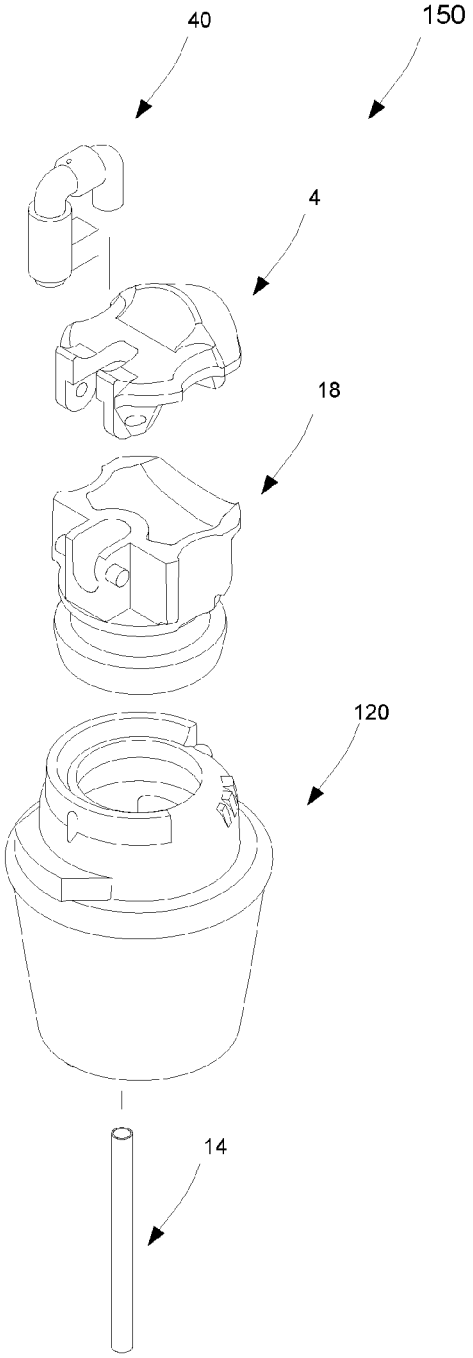
FIG. 33 shows an exploded view of a second embodiment of a personal aqueous dispensing system utilizing the second cap design.
Figure 34:
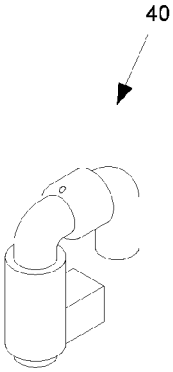
FIG. 34 shows an isometric view of a connection elbow shown in FIG. 33.
Figure 35:
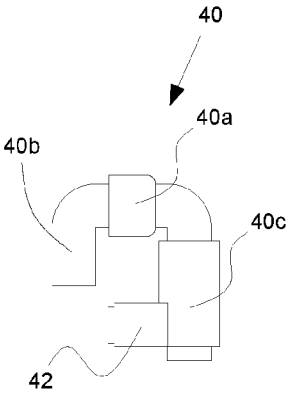
FIG. 35 shows a side view of the connection elbow shown in FIG. 34.
Figure 36:
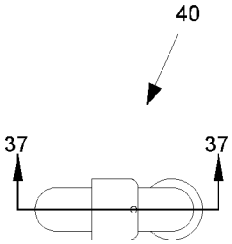
FIG. 36 shows a top view of the connecting elbow shown in FIG. 34.
Figure 37:
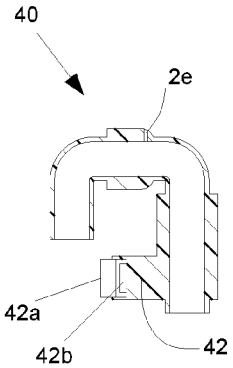
FIG. 37 shows cross-sectional view 37-37 of the connecting elbow shown in FIG. 36.

FIG. 29 shows a dispensing kit 400 utilizing a second embodiment of a personal aqueous dispensing system 150 shown in an exploded view in FIG. 33. The dispensing system 150 includes a cap 120 that offers an arcuate stop 120*d* shown in FIG. 30 that allows the insert 18 to rotate in a quarter turn. The arcuate stop also has two ends 120*q*, which delimit the arcuate stop 120*d*. Similar features of the cap 120 are present as those found in cap 12. For instance, indicator 12*m* is set in an equator location to indicate full flow. The same set of indicators 12*x*-12*z* are used to indicate the user how much the insert has been rotated. An opposite indicator 12*n*, located opposite to indicator 120*m*, provides for an indication where one would insert the nozzle 40. This embodiment of the cap 120 offers a trigger 122 that extends transversely to a longitudinal axis of the cap 120. The trigger 122 is delimited by a first ramp 122*a* and a second ramp 122*b*. The ramps 122*a*, 122*b* provide for glide motion to activate a mechanical switch 42 or also serve to provide echo range when using listening devices or devices that utilize proximity detection of surfaces via magnetic or infrared devices. For instance, when a sensor uses infrared, the sensor will become fully active when the sensor has reached the peak of the ramp. The second ramp 122*b* is there to work in reverse turning of the insert 18 especially when accidental turning of the cap 18 beyond the arcuate stop 120*d* occurs as the cap 120 is made of rubber material.

FIGS. 33-37 show a modified version of the nozzle 40. Unlike nozzle 4, the nozzle 40 includes a third conduit 40*c* that is parallel to a first conduit 40*b*. Second conduit 4*a* bridges between the first conduit 40*b* and the third conduit 40*c*. The third conduit 40*c* will be longer than the first conduit 40*b* and will include a mechanical switch 42 that is open. The mechanical switch 42 commonly has a movable contact 42*a* that when moved to a closed position will close the circuit 42*b* or send an electronic signal via a pair of cables 180*d* or just using one cable activating a solenoid 180*c* that is part of an electronic pressure regulator 180*a*. The solenoid 180*c* will then control valve 180*b* thus releasing nitrogen into the bottle 16. While not shown, the nozzle 40 can also include a handle 2*c* similar to that found in nozzle 2.

The caps 12, 22, 120 are to be made from a flexible material such as silicone or rubber to allow for expansion and fit over many size neck bottles. It is also envisioned that the caps 12, 22, 120 can be made of a rigid material than the flexible material. The inserts 8, 18, lid 4, nozzle 2, 40, and vent tube 14 are made from a thermoplastic but could as well be made from metal or casted in metal. The spacing seal 6 is to be made from a flexible material such as a silicone or rubber material. It is also envisioned that the personal dispensing systems 10, 100, 150 can include at least one accessory cap 22 or none at all. While the cap 120 is shown and utilized in the personal aqueous dispensing system, the same cap 120 can be utilized in the personal oil dispensing system.

It is further envisioned that the mechanical switch 42 can be replaced with a proximity sensor that works with magnetism, ultrasound, optical light, or infrared light so that when the beam of the ultrasound, magnetism, or lights approaches the trigger 122, the solenoid 180*c* activates based on how close the sensor is to the trigger 122.

The invention claimed is:

1. A dispenser system comprising a cap and an insert;
wherein the cap comprises an insertion portion and a retaining portion;
wherein the insert comprises a radial flange at one end and a grip body at an opposite end;
wherein the radial flange is retained in the retaining portion sealingly and rotabably fixing the insert to the cap;
wherein the cap and the inset each include a longitudinal axis extending in the same direction;
wherein the insert further includes a vent and a pour opening both extending through the insert and each located 180 degrees apart relative to the longitudinal axis of both the insert and the cap;
wherein the cap further includes a corresponding vent and a corresponding pour opening to align when the insert is in an open position for pouring; and,
wherein the insert being rotatable relative to the longitudinal axis of the cap and the insert.

2. The dispenser system of claim 1, wherein the insert is quarter-turn rotatable to open and close the insert;
wherein the insert includes an alignment tab; and,
wherein the cap further includes indicators to position the alignment tab at different positions to further close or open the insert.

3. The dispenser system of claim 2, wherein one of the indicators is distinct from the others to indicate a complete opening.

4. The dispenser system of claim 3, wherein several of the indicators are mirrored relative to the one that is distinct.

5. The dispenser system of claim 2, wherein the cap further includes radially inward suction cavities at the insertion portion.

6. The dispenser system of claim 5, wherein the cap further includes an annular suction cavity spaced from the inward suction cavities.

7. The dispenser system of claim 2, wherein the cap further includes an arcuate stop to prevent the insert from rotating when the alignment tab hits an end of the arcuate stop.

8. The dispenser system of claim 7, wherein the cap further includes a trigger projecting radially from the longitudinal axis of the cap and comprising at least one ramp.

9. The dispenser system of claim 8, further comprising a nozzle insertable in the vent of the insert;
wherein the nozzle comprises a flow path to stream with the vent of the insert; and,
wherein the nozzle including a switch to engage the trigger of the cap.

10. The dispenser system of claim 9, further including a nitrogen-filled canister, a pressure regulator, a solenoid valve, and a hose connected to the nozzle to provide nitrogen to a bottle when the vent of the insert is in alignment with the vent of the cap.

11. The dispenser system of claim 7, further comprising a nozzle insertable in the vent of the insert;
wherein the nozzle comprises a flow path to stream with the vent of the insert; and,
wherein the nozzle further includes a pilot vent extending into the flow path of the nozzle and terminating with an engagement surface.

12. The dispenser system of claim 11, wherein the lid further includes a corresponding engagement surface to mate with the engagement surface of the nozzle to block the pilot vent when the lid is in an opened position.

13. The dispenser system of claim 11, wherein the lid further includes at least one alignment tapered peg to assist in closing the peg against the insert.

14. The dispenser system of claim 11, further including a nitrogen-filled canister, a pressure regulator, and a hose connected to the nozzle to provide nitrogen to a bottle when the vent of the insert is in alignment with the vent of the cap.

15. The dispenser system of claim 1, further comprising a lid rotatable relative to the insert;
wherein the lid comprises a body, a pair of pivot lugs, and at least one arcuate cantilever tab;
wherein the pivot lugs each include a hole respectively mating with a pivot pin of the insert; and,
wherein the pivot lugs project from body in one direction and the arcuate cantilever tab projects in an opposite direction from the body.

16. The dispenser system of claim 1, further comprising a vent tube connected to the vent of the cap.

17. The dispenser system of claim 1, wherein the insert includes a pair of opposite notches to allow a user to grasp the insert for turning.

18. The dispenser system of claim 1, wherein the insert further includes a pour spout in alignment with the pour opening.

19. The dispenser system of claim 18, wherein the insert further includes at least one retaining peg retaining a flexible spacing seal comprising a vent hole and at least one retaining hole.

20. The dispenser system of claim 19, wherein the spacing seal further includes an alignment nipple concentric with the vent hole of the spacing seal.

21. The dispenser system of claim 20, further comprising a lid rotatable relative to the insert;

wherein the lid comprises a body, a pair of pivot lugs, and at least one arcuate cantilever tab;

wherein the pivot lugs each include a hole mating with a pivot pin of the insert; and, wherein the pivot lugs project from body in one direction and the arcuate cantilever tab projects in an opposite direction from the body.

22. The dispenser system of claim 19, further comprising a nozzle to be placed against the vent hole of the spacing seal;

wherein the nozzle comprises a flow path to stream with the vent of the insert; and, wherein the nozzle further includes a pilot vent extending into the flow path of the nozzle.

23. The dispenser system of claim 1, in combination with an accessory cap comprising an annular body, a closed end, and an insertion portion;

wherein the insertion portion of the accessory cap includes a series of inward suction cavities.

24. The dispenser system of claim 23, wherein at least one annular suction cavity being spaced from the inward suction cavities of the accessory cap.

* * * * *